United States Patent [19]

Manfredi

[11] Patent Number: 4,472,232

[45] Date of Patent: Sep. 18, 1984

[54] ELECTRICALLY OPERATED LABELLING MACHINE

[76] Inventor: John Manfredi, 1976 Sixth St., North Brunswick, N.J. 08902

[21] Appl. No.: 310,970

[22] Filed: Oct. 13, 1981

[51] Int. Cl.[3] ..... B65C 9/46; B65C 11/02

[52] U.S. Cl. ..... 156/368; 101/288; 156/384; 156/579; 156/DIG. 47; 156/DIG. 49; 221/72; 221/73

[58] Field of Search ..... 156/367, 368, 384, 541, 156/577, 579, 355, 361, 364, 518, DIG. 33, 47, 48, 49, 536; 101/288; 221/72, 73

[56] References Cited

U.S. PATENT DOCUMENTS 2,763,481 9/1956 Hackett ..... 156/DIG. 48

3,649,413 3/1972 Way ..... 156/518

*Primary Examiner*—Michael G. Wityshyn

*Attorney, Agent, or Firm*—Thomas R. Farino, Jr.

[57] ABSTRACT

An improved electrically operated labelling machine is disclosed. The improved labelling machine comprises a frame for receiving and supporting a labelling gun adjacent its forward position. The mounting means is detachably connected to the frame for positioning the labelling gun. A solenoid is secured to the frame adjacent its rear portion. An arm mounted for horizontal reciprocal movement is connected to the solenoid and detachably linked to the gun trigger. Means are provided for energizing the solenoid for operation through a complete cycle including an advance stroke and a return stroke thereby actuating the labelling gun for accomplishing printing and cutting of labels.

3 Claims, 3 Drawing Figures

ELECTRICALLY OPERATED LABELLING MACHINE

BACKGROUND OF THE INVENTION

This invention relates to electrically operated labelling machines and more particularly, to such a device adapted for electro-magnetic operation. Thusly arranged, a label printer in the form of a gun, is used for the high speed printing of labels such as price labels for supermarket retail commodities.

In the prior art, electro-magnetically operated printing devices have been proposed but have not proven satisfactory in practice. Prior art units have been unable to meet present day operating conditions and have employed components of such a size as to be inconveniently useable. As a result, the expense of such devices was considerable coupled with resultant low operating efficiency.

SUMMARY OF THE INVENTION

Briefly, the present invention provides an improved electrically operated labelling machine which overcomes the disadvantages of the prior art arrangements through the utilization of a structure of relatively small size which serves as a support for a labelling gun-type unit. Within the support structure, a solenoid is suitably positioned for use in operating the labelling arrangement. Operation of the labelling unit is accomplished by linking the trigger mechanism of the labelling gun and the moveable armature portion of the solenoid by means of a rod member. As linked in this fashion, the armature portion of the solenoid and the rod member serve as the connecting medium. The connection between the solenoid and the trigger assembly is preferably of a rather rigid character in that the solenoid is drawn abruptly upon energization. Upon solenoid energization, the thereto-attached rod moves a distance substantially axially of the solenoid for both the advance and return strokes in the operation. The opposite end of the connecting rod member may then be actuatingly linked with the trigger assembly of the labelling gun so as to print, cut and discharge printed labels upon actuation of the trigger assembly. So arranged, actuation of the labelling machine may be provided by closing, through the use of a switch or an equivalent, an electrical circuit to energize the solenoid and thereby operate the labelling unit.

DESCRIPTION OF THE PREFERRED EMBODIMENT

Figure 1:
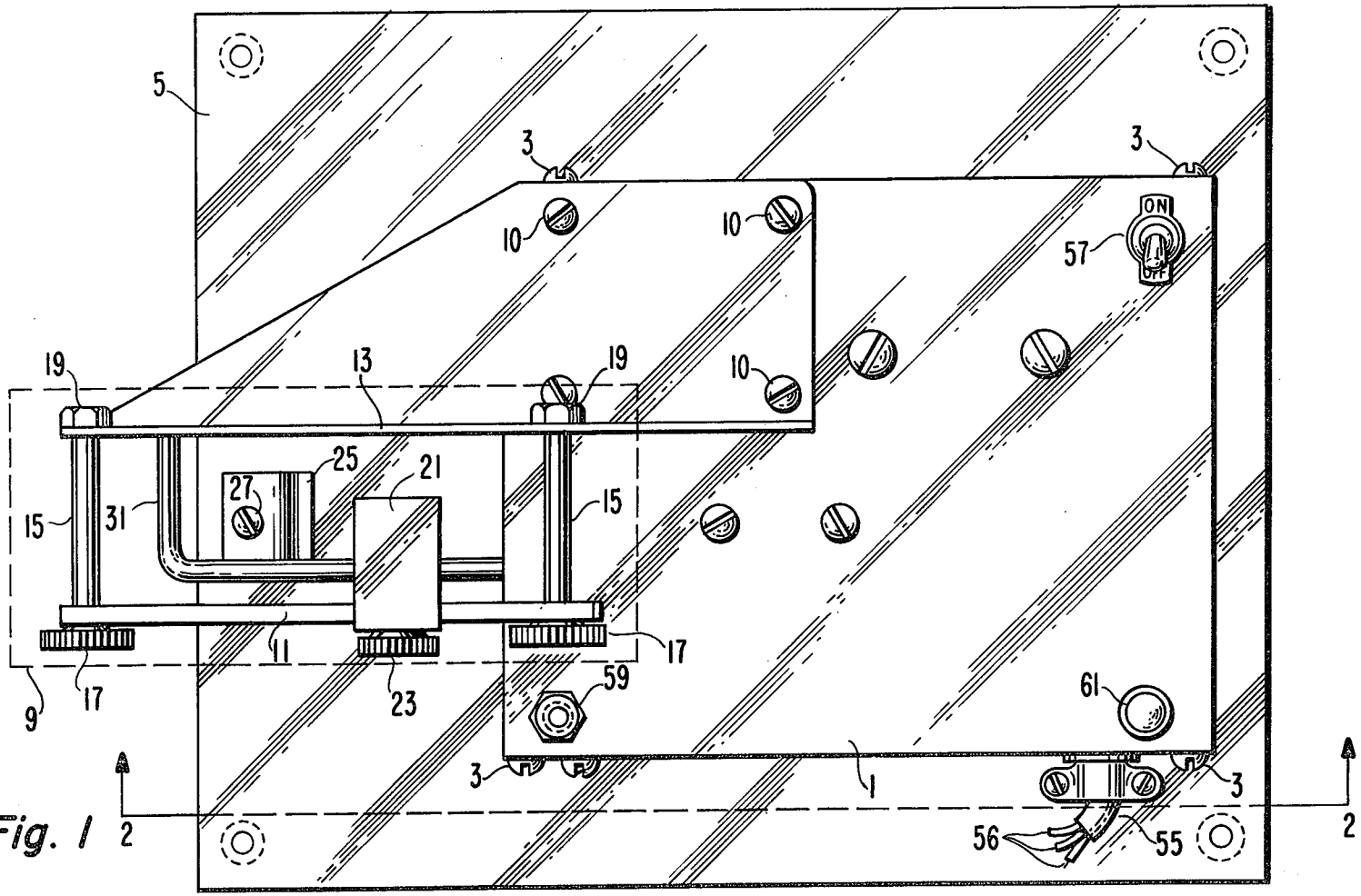
FIG. 1 is a top plan view of one form of the apparatus.
Figure 2:
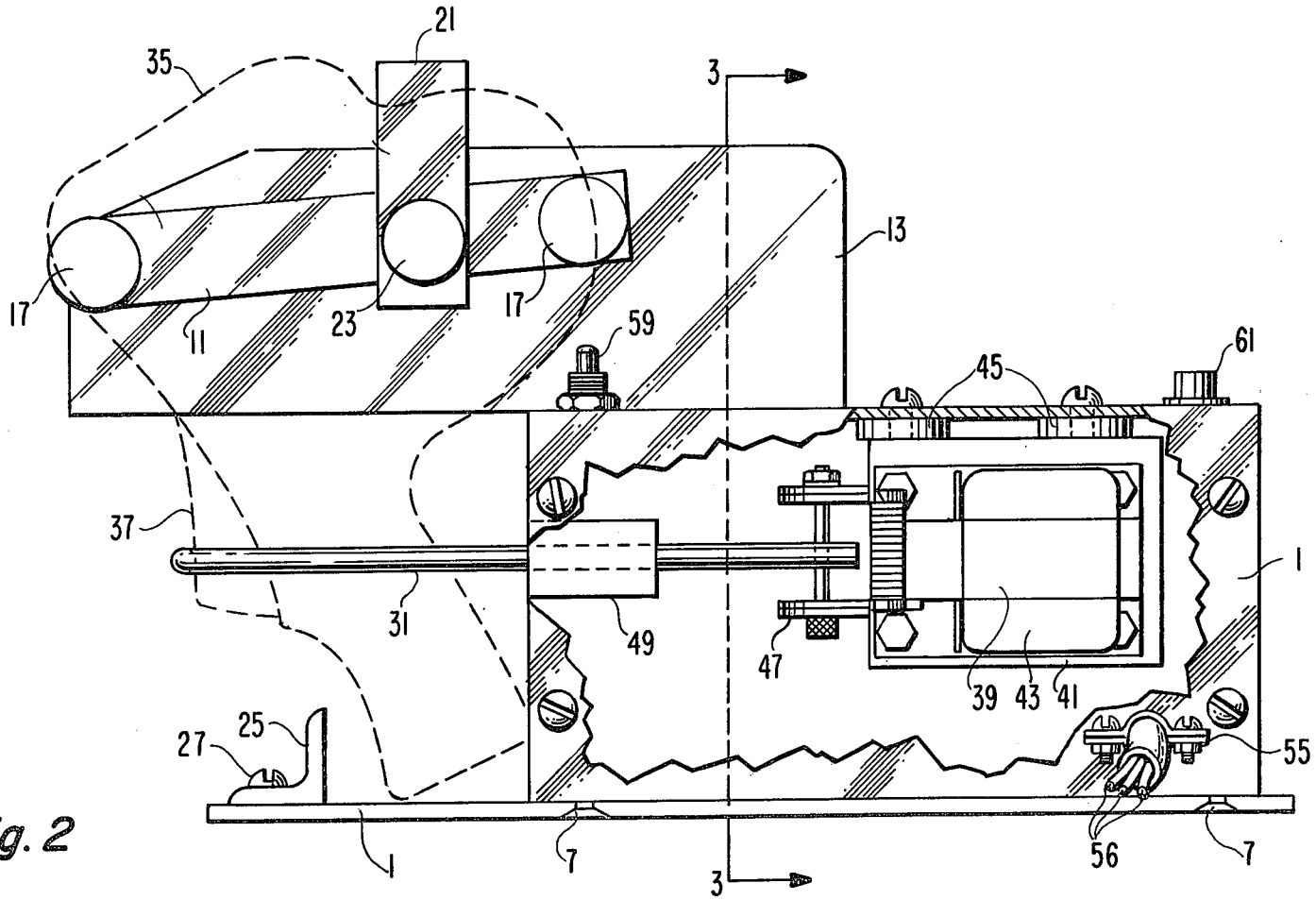
FIG. 2 is a longitudinal vertical sectional view taken substantially along line 2—2 in FIG. 1 and showing the circuit for the solenoid.
Figure 3:
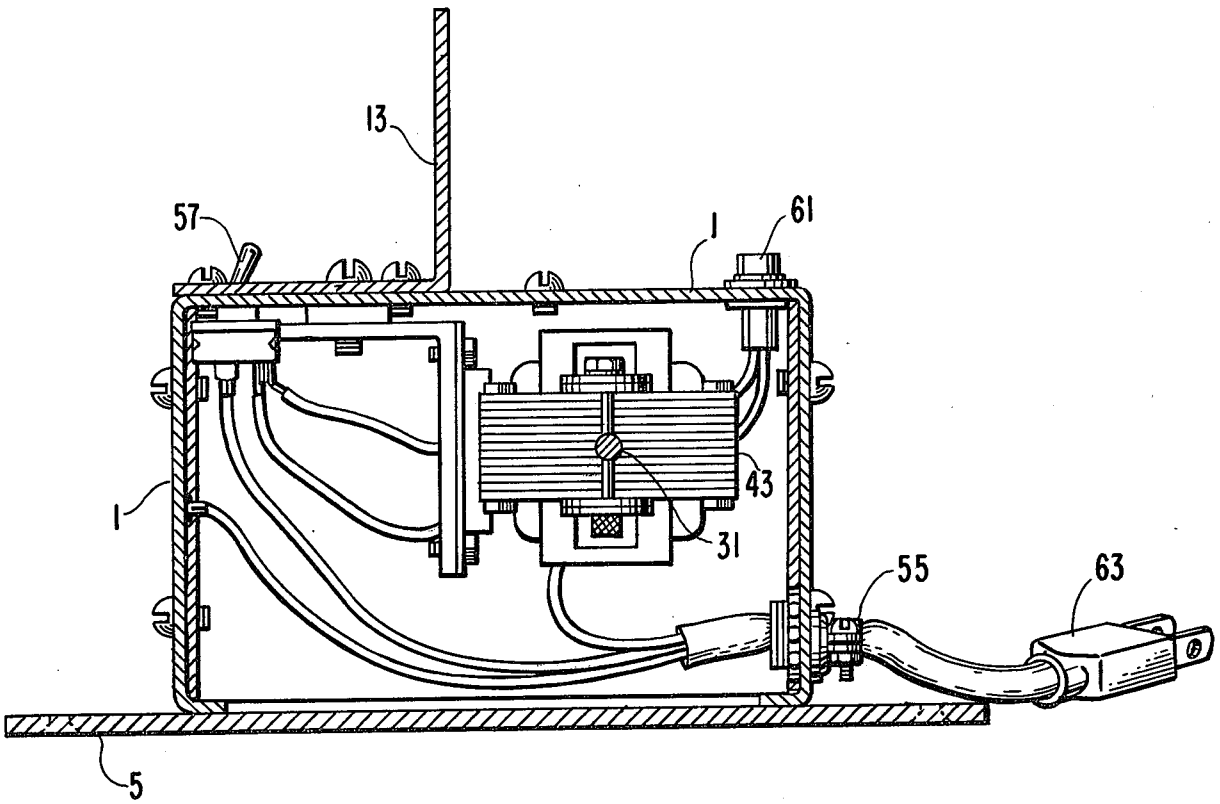
FIG. 3 is a transverse vertical sectional view, mostly in elevation, taken substantially along line 3—3 in FIG. 2.

Referring to the drawings, there is shown in FIG. 1 an improved electrically operated labelling machine utilizing a gun type label printer for the high speed printing of labels.

There is shown in FIG. 1 a suitable housing 1, which may be in the form of a box-like structure including top and bottom walls, side walls and front and rear end walls, the assembly of which is achieved by means of screws 3. A substantially rectangular mounting plate 5 is affixed to housing 1 by means of mounting screws 7 for securing the labelling machine to some suitable surface.

Label gun 35 is suitably secured to the forward portion of the outer surface of the frame or housing 1 by means of mounting assembly 9. Mounting assembly 9 comprises bracket 11 which is positioned with respect to face plate 13 by means of mounting bolts 15, adjusting screws 17 and nuts 19. Face plate 13 is affixed to the top surface of housing 1 by means of mounting screws 10. Positioning plate 21 is affixed to bracket 11 by means of screw 23 and restrains labelling gun 35 from vertical movement while in mounting assembly 9. Toe plate 25, affixed to mounting plate 5 by means of screw 27, abuts the forward portion of the handle of labelling gun 35 and restrains the labelling gun from forward lateral movement while positioned in mounting assembly 9. Adjusting screws 17 allow for the snug positioning of labelling gun 35 in proper relationship with rod 31.

Labelling gun 35 has a trigger assembly 37 which, upon actuation, provides for the printing, cutting and dispensing of labels.

The improved electrically operated or controlled means for actuating label gun 35 comprises a solenoid broadly designated at 39 and including a substantially rectangular frame 41 in which a coil 43 is secured. The frame 41 is suitably secured to the inner surface of the top wall of frame 1 by screw assemblies 45. Mounted for horizontal reciprocal movement in the central portion of the frame 1 and within the coil 43 is a solenoid plunger 47.

The plunger 47 is connected to the labelling gun 35 by means of rod 31. Rod 31 is positioned for reciprocal lateral movement by means of bushing assembly 49 which is in turn affixed to the front wall of frame 1. Rod 31 slidably penetrates bushing 49 for guided reciprocal movement in conjunction with the operation of solenoid assembly 39.

The coil 43 of solenoid 39 has a cable 55 extending therefrom in which three wires or conductors 56 are disposed, corresponding ends of which wires 56 being connected to opposite ends of the coil 43 and the other ends of the wires 56 being connected to a suitable on-off switch 57 of the toggle-type arrangement. Wires 56 are also connected to switch 59 which switch controls energization of solenoid assembly 39. Light 61 is also connected to wires 56 for providing a suitable indication of a power on condition. The other end of wires 56 are connected to a suitable plug 63 adapted to be connected to a suitable source of electrical energy not shown.

Upon closing switch 59, coil 43 of the solenoid 39 is energized to cause sudden rearward lateral movement of the plunger 47 and to thereby impart corresponding rearward lateral movement to rod 31. As the front end of rod 31, which is detachably engaged with trigger assembly 37 of labelling gun 35 moves in a laterally rearward manner, it is apparent that trigger assembly 37 is thereby actuated causing the printing, cutting and dispensing of appropriate labels.

It is further apparent that upon switch 59 again being opened, coil 43 of solenoid 39 is de-energized, thereby effecting the return stroke of the solenoid with plunger 47 returning to its original position which in turn causes rod 31 to move forward laterally and thus permit trigger assembly 37, which is spring loaded, to return to its original position for subsequent actuation.

The foregoing is considered as illustrative only of the principles of the invention. Further, since numerous modifications and changes will readily occur to those skilled in the art, it is not desired to limit the invention to the exact construction and operation shown and described.

I claim:

1. An improved electrically operated labelling machine adapted to receive a labelling gun having a handle and a trigger assembly for printing and cutting labels upon actuation thereof, said improved actuator comprising:

a frame adapted to support said labelling gun adjacent its forward portion;

electrically operated means secured to said frame adjacent its rear portion;

a curved arm mounted for horizontal reciprocal movement in said electrically operated means and detachably linked to said trigger;

an adjustable mounting bracket positioned by means of mounting bolts and adjusting screws including a positioning plate movably attached to said mounting bracket which in combination with a toe plate rigidly attached to said frame and said curved arm, enables a variety of labelling gun sizes and shapes to be securely positioned and interchanged;

means for energizing said electrically operated means for operation through a complete cycle including an advance stroke and a return stroke such that upon energization of the electrically operated means through a complete cycle, the labelling gun is actuated for accomplishing the printing and cutting of labels.

2. An improved electrically operated labelling machine of claim 1 wherein said electrically operated means comprises a single solenoid.

3. An improved electrically operated labelling machine adapted to receive a labelling gun having a handle and a trigger assembly for printing and cutting labels upon actuation thereof, said improved actuator comprising:

a frame adapted to support said labelling gun adjacent its forward portion;

an adjustable mounting bracket positioned by means of mounting bolts and adjusting screws including a positioning plate movably attached to said mounting bracket which in combination with a toe plate rigidly attached to said frame and said curved arm, enables a variety of labelling gun sizes and shapes to be securely positioned and interchanged;

a solenoid secured to said frame adjacent its rear portion;

a curved arm mounted for horizontal reciprocal movement in said solenoid and detachably linked to said trigger;

means for energizing said solenoid for operation through a complete cycle including an advance stroke and a return stroke and linked to said trigger such that upon energization of the solenoid through a complete cycle, the advance stroke will actuate said trigger for accomplishing the printing and cutting of labels and the return stroke will permit the re-setting of said trigger for subsequent actuation thereof.

* * * * *